US006783215B2

(12) United States Patent
Yoshida et al.

(10) Patent No.: US 6,783,215 B2
(45) Date of Patent: Aug. 31, 2004

(54) INK CONTAINER, INKJET PRINTING APPARATUS, AND INK SUPPLYING METHOD

(75) Inventors: Masahito Yoshida, Saitama (JP); Naoji Otsuka, Kanagawa (JP); Hiroyuki Inoue, Kanagawa (JP); Takashi Nojima, Tokyo (JP); Hitoshi Sugimoto, Kanagawa (JP); Shusuke Inamura, Tokyo (JP); Yasufumi Tanaami, Tokyo (JP); Takeshi Iwasaki, Kanagawa (JP); Noriko Sato, Tokyo (JP); Yasuyuki Hirai, Kanagawa (JP); Takeshi Yazawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/369,552

(22) Filed: Feb. 21, 2003

(65) Prior Publication Data

US 2003/0160846 A1 Aug. 28, 2003

(30) Foreign Application Priority Data

Feb. 25, 2002 (JP) ..... 2002-048641

(51) Int. Cl.[7] ..... B49J 2/175; B65B 9/04; B05B 11/06

(52) U.S. Cl. ..... 347/85; 141/359; 222/633

(58) Field of Search ..... 347/85; 141/114, 141/25, 347, 351; 222/527, 633

(56) References Cited

U.S. PATENT DOCUMENTS 4,422,084 A * 12/1983 Saito ..... 347/7
5,745,137 A * 4/1998 Scheffelin et al. ..... 347/85
5,886,718 A * 3/1999 Johnson et al. ..... 347/85
6,199,975 B1 * 3/2001 Baitz et al. ..... 347/85

* cited by examiner

*Primary Examiner*—Anh T. N. Vo
(74) *Attorney, Agent, or Firm*—Fitzpatrick, Cella, Harper & Scinto

(57) ABSTRACT

In a supply system which includes an ink container for reserving a predetermined amount of ink to be supplied to a printing head and which is configured such that ink is intermittently supplied to the container from an ink tank, there is provided a structure that fundamentally eliminates waste of ink associated with an operation of charging the container to apply a required negative pressure to the head. An ink containing body in which a negative pressure can be generated because of its elasticity is provided in the container. After the ink containing body is expanded to introduce ink into the same by depressurizing the interior of the container, the interior of the container is pressurized to contract the ink containing body, thereby returning a predetermined amount of ink to the tank. A negative pressure is thus generated in equilibrium with an ink meniscus holding ability of the head.

16 Claims, 9 Drawing Sheets

INK CONTAINER, INKJET PRINTING APPARATUS, AND INK SUPPLYING METHOD

This application claims priority from Japanese Patent Application No. 2002-048641 filed Feb. 25, 2002, which is incorporated hereinto by reference.

BACKGROUND OF THE INVENTION

1. Field of the Invention

The present invention relates to an ink container, an inkjet printing apparatus utilizing the ink container, and an ink supplying method and, more particularly, the invention is preferably applied to an inkjet printing apparatus in which ink is intermittently supplied to a printing head for ejecting ink.

2. Description of the Related Art

Inkjet printing apparatuses which form an image on a printing medium by depositing ink to the printing medium using an inkjet printing head include that which form an image by ejecting ink while moving a printing head relative to a printing medium and that which form an image by ejecting ink while moving a printing medium relative to a fixed printing head conversely.

There are two general types of methods of supplying ink to a printing head used in such an inkjet printing apparatus. One is a type in which a supply system is configured such that an amount of ink is always or continuously supplied to a printing head according to the amount of ink ejected (hereinafter referred to as a continuous supply type), and the other is a type in which a printing head is provided with a reservoir (sub-tank or second ink tank) for reserving a predetermined amount of ink and in which a supply system is configured such that ink is supplied to the reservoir from an ink supply source (main tank or first ink tank) at appropriate timing or intermittently (hereinafter referred to as an intermittent supply type).

The continuous supply type is further categorized into two types, for example, when it is used in an inkjet printing apparatus of a type referred to as a serial type in which a printing head is scanned back and forth in predetermined directions relative to a printing medium and in which the printing medium is transported in a direction substantially orthogonal thereto to form an image. One is a type referred to as an on-carriage type in which ink is supplied by integrally or detachably attaching an ink tank to a printing head that is carried and moved back and forth (main scanning) by a carriage. The other is a tube supply type in which an ink tank that is separate from a printing head carried on a carriage is fixedly installed in a part of a printing apparatus other than the printing head and in which the ink tank is connected to the printing head through a flexible tube to supply ink. In some of the latter type, a second ink tank that serves as an intermediate tank between an ink tank and a printing head is mounted on the printing head or the carriage.

When an on-carriage type structure is adopted, there are limits on the project area in a direction perpendicular to the main scanning direction and volume of members that move with a carriage (a printing head and an ink tank undetachably or detachably integrated with the same). Therefore, only an ink tank having a very limited capacity can be used when a small-sized printing apparatus, especially, a portable printing apparatus is to be formed. This results in very frequent replacement of the printing head integral with the ink tank or the ink tank alone, which has been problematic from the viewpoint of operability and running cost. Further, the recent spread of so-called mobile apparatus is remarkable and, for example, ultra-compact inkjet printers have been proposed which can be integrated with notebook type personal computers and digital cameras. It is considered impractical to design such printers in adaptation to the on-carriage method.

When a tube supply type structure is adopted, although members that move with a carriage during main scanning can be made compact to some degree, it is difficult to make the apparatus as a whole compact because a space is required for a tube member to move to follow up the carriage, the tube member coupling a printing head on the carriage and an ink tank located outside the carriage to supply ink. Further, the recent trend is that a carriage is scanned at a high speed to accommodate increases in the speed of printing operations, and resultant severe rocking of a tube that follows the carriage results in changes in the pressure of ink in an ink supply system for the printing head. It is therefore required to provide various complicated pressure buffering mechanisms in order to suppress pressure changes, it has been difficult to achieve a size reduction in this respect too.

On the contrary, in the case of the intermittent supply method that is used for serial type inkjet printing apparatus for example, a relatively small second ink tank and printing head are provided on a carriage; a relatively large first ink tank is provided in a part other than the carriage of the printing apparatus; and a supply system is configured such that ink is supplied from the first ink tank to the second ink tank at appropriate timing. A structure is also employed in which the ink supply system between the first and second ink tanks is spatially separated or the ink channel is blocked with a valve during main scanning to achieve fluid isolation between the first and second ink tanks. Basically, this makes it possible to solve various problems attributable to the size of moving members as described above such as an ink tank and the rocking of a tube that have limited efforts to achieve a small size in the case of the continuous supply type.

When an intermittent supply type structure is adopted, however, it is important to adjust the pressure inside a second ink tank properly, because a negative pressure relative to the atmosphere must be generated in order to maintain ink meniscuses formed at ejection openings. While the second ink tank may be located in a position lower than the position of ejection openings of the printing head to generate a negative pressure in the second ink tank naturally, this puts a limit on even the position and attitude or orientation of the ink tank and has resulted in problems including leakage of ink from the ejection openings especially in case that a portable printing apparatus is to be provided which is unstable in attitude or orientation during transportation.

Under such circumstances, proposals have been made including a proposal in which a porous member such as a sponge for holding ink is contained a second ink tank to generate an adequate negative pressure. Such a structure is advantageous even for a portable printing apparatus whose attitude is unstable during transportation. However, the ink containing efficiency of the second ink tank is limited by the negative pressure generating mechanism such as a porous member provided in the second ink tank. Further, designing may be limited with respect to the endurance of the porous member against deposition and deterioration of a dye or pigment in ink, which also reduces freedom in selecting ink.

Further, in such a structure, since the porous member is always over-charged with ink when ink charging is completed, the over-charged ink in the porous member must be discharged as waste ink without fail by performing an operation of sucking the printing head through the ejection openings after the charging is completed in order to apply a required negative pressure to the printing head. That is, a problem arises in that a charging operation is accompanied by the generation of waste ink.

SUMMARY OF THE INVENTION

The invention was conceived taking the above-described problems into consideration, and it employs an intermittent supply system as an ink supplying method and provides a structure which does not fundamentally result in waste of ink such as generation of waste ink associated with a charging operation to apply a predetermined negative pressure to a printing head, which achieves high charging efficiency and a short charging time, and which can be easily kept resistant to ink, i.e., a structure with which freedom in selecting ink can be increased.

The invention thus contributes to the structure of a compact and portable inkjet printing apparatus.

In a first aspect of the present invention, there is provided an ink container that can be disposed halfway of an ink supply path connecting a printing head for performing printing by ejecting ink and an ink tank serving as a supply source of ink to be supplied to the printing head, comprising:

an ink containing body capable of containing ink introduced thereto from the ink tank in a state in which it is in fluid communication with the ink tank, the ink containing body supplying the ink contained therein to the printing head during printing and having a part that can be displaced in the direction of increasing an internal volume thereof to introduce the ink;

a housing having an inner space in which a pressure can be adjusted, the housing allowing the ink containing body to be contained in the space and allowing an increase in the internal volume thereof in accordance with the pressure adjustment; and means provided at the ink containing body for urging the ink containing body in the direction of increasing of the internal volume of the same to generate a negative pressure that is in equilibrium with an ability to hold meniscus formed at an ink ejecting portion of the printing head, wherein the ink containing body has a flexible structure which expands when the inner space of the housing is depressurized to increase the internal volume and which contracts when the inner space of the housing is pressurized to decrease the internal volume; and the urging means generates the negative pressure when the inner space of the housing is pressurized to decrease the internal volume of the ink containing body after the internal volume of the ink containing body is maximized as a result of depressurization of the inner space of the housing.

In a second aspect of the present invention, there is provided a printing head unit comprising:

a printing head for performing printing by ejecting ink; and an ink container that can be disposed halfway of an ink supply path connecting the printing head and an ink tank serving as a supply source of ink to be supplied to the printing head, having:

an ink containing body capable of containing ink introduced thereto from the ink tank in a state in which it is in fluid communication with the ink tank, the ink containing body supplying the ink contained therein to the printing head during printing and having a part that can be displaced in the direction of increasing an internal volume thereof to introduce the ink;

a housing having an inner space in which a pressure can be adjusted, the housing allowing the ink containing body to be contained in the space and allowing an increase in the internal volume thereof in accordance with the pressure adjustment; and means provided at the ink containing body for urging the ink containing body in the direction of increasing of the internal volume of the same to generate a negative pressure that is in equilibrium with an ability to hold meniscus formed at an ink ejecting portion of the printing head, wherein the ink containing body has a flexible structure which expands when the inner space of the housing is depressurized to increase the internal volume and which contracts when the inner space of the housing is pressurized to decrease the internal volume; and the urging means generates the negative pressure when the inner space of the housing is pressurized to decrease the internal volume of the ink containing body after the internal volume of the ink containing body is maximized as a result of depressurization of the inner space of the housing.

In a third aspect of the present invention, there is provided an inkjet printing apparatus utilizing a printing head for performing printing by ejecting ink, an ink tank serving as a supply source of ink to be supplied to the printing head, and the ink container according to the above first aspect provided halfway of an ink supply path connecting them, comprising:

a channel opening and closing unit for establishing and blocking fluid communication between the ink tank and the ink containing body; and a pressure regulating unit for reducing the pressure in the inner space of the housing in the communicated state to increase the internal volume of the ink containing body and for increasing the pressure in the inner space of the housing to decrease the internal volume of the ink containing body.

In a fourth aspect of the present invention, there is provided an ink supplying method used for an inkjet printing apparatus utilizing a printing head for performing printing by ejecting ink, an ink tank serving as a supply source of ink to be supplied to the printing head, and the ink container according to the above first aspect provided halfway of an ink supply path connecting them, and used for supplying the ink to the ink container from the ink tank, the method comprising the steps of:

establishing fluid communication between the ink tank and the ink containing body;

reducing the pressure in the inner space of the housing in the communicated state to increase the internal volume of the ink containing body, thereby introducing ink from the ink tank to the ink containing body; and increasing the pressure in the inner space of the housing in the communicated state to decrease the internal volume of the ink containing body, thereby introducing ink from the ink containing body to the ink tank, a negative pressure being thus generated in the ink containing body in equilibrium with an ability to hold meniscus formed at an ink ejecting portion of the printing head.

In a fifth aspect of the present invention, there is provided a method for supplying ink to an ink container for containing ink to be supplied to a printing head for performing printing by ejecting ink from an ink tank, the ink container accommodating an ink containing body capable of containing the ink therein and capable of generating a negative pressure by an elastic force, the method comprising the steps of:

establishing fluid communication between the ink tank and the ink containing body;

depressurizing the interior of the ink container to expand the ink containing body, thereby introducing the ink to the ink containing body from the ink tank; and pressurizing the interior of the ink container to contract the ink containing body, thereby introducing ink from the ink containing body to the ink tank, a negative pressure being thus generated in the ink containing body in equilibrium with an ability to hold meniscus formed at an ink ejecting portion of the printing head.

In a sixth aspect of the present invention, there is provided a method for supplying ink to an ink container for containing ink to be supplied to a printing head for performing printing by ejecting ink from an ink tank, the ink container accommodating an ink containing body capable of containing the ink therein and capable of changing an internal volume thereof with a flexible structure, the method comprising the steps of:

establishing fluid communication between the ink tank and the ink containing body;

increasing the internal volume of the ink containing body, thereby introducing the ink to the ink containing body from the ink tank; and decreasing the internal volume of the ink containing body, thereby introducing ink from the ink containing body to the ink tank, a negative pressure being thus generated in the ink containing body in equilibrium with an ability to hold meniscus formed at an ink ejecting portion of the printing head.

Incidentally, in the present specification, the wording "printing" means not only a condition of forming significant information such as characters and drawings, but also a condition of forming images, designs, patterns and the like on printing medium widely or a condition of processing the printing media, regardless of significance or unmeaning or of being actualized in such manner that a man can be perceptive through visual perception.

Further, the wording "printing medium" means not only a paper used in a conventional printing apparatus but also everything capable of accepting inks, such as fabrics, plastic films, metal plates, glasses, ceramics, wood and leathers, and in the following, will be also represented by a "sheet" or simply by "paper".

Still further, the wording "ink" (also referred to as "liquid" in some occasions) should be interpreted in a broad sense as well as a definition of the above "printing" and thus the ink, by being applied on the printing media, shall mean a liquid to be used for forming images, designs, patterns and the like, processing the printing medium or processing inks (for example, coagulation or encapsulation of coloring materials in the inks to be applied to the printing media).

Meantime, the present invention may be applied to a printing head in which a thermal energy generated by an electrothermal transducer is utilized to cause a film boiling to liquid in order to form bubbles, a printing head in which an electromechanical transducer is employed to eject liquid, a printing head in which a static electricity or air current is utilized to form and eject a liquid droplet and the others which are proposed in the art of an inkjet printing technology. Specifically, the printing head in which the electrothermal transducer is utilized is advantageously employed to achieve a compact structure.

Still further, the wording "nozzle", as far as not mentioned specifically, represents to an ejection opening, a liquid passage communicated with the opening and an element for generating an energy used for ink, in summary.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

The invention will now be described in detail with reference to the drawings.

(Example of Structure of Inkjet Printing Apparatus)

Figure 1:
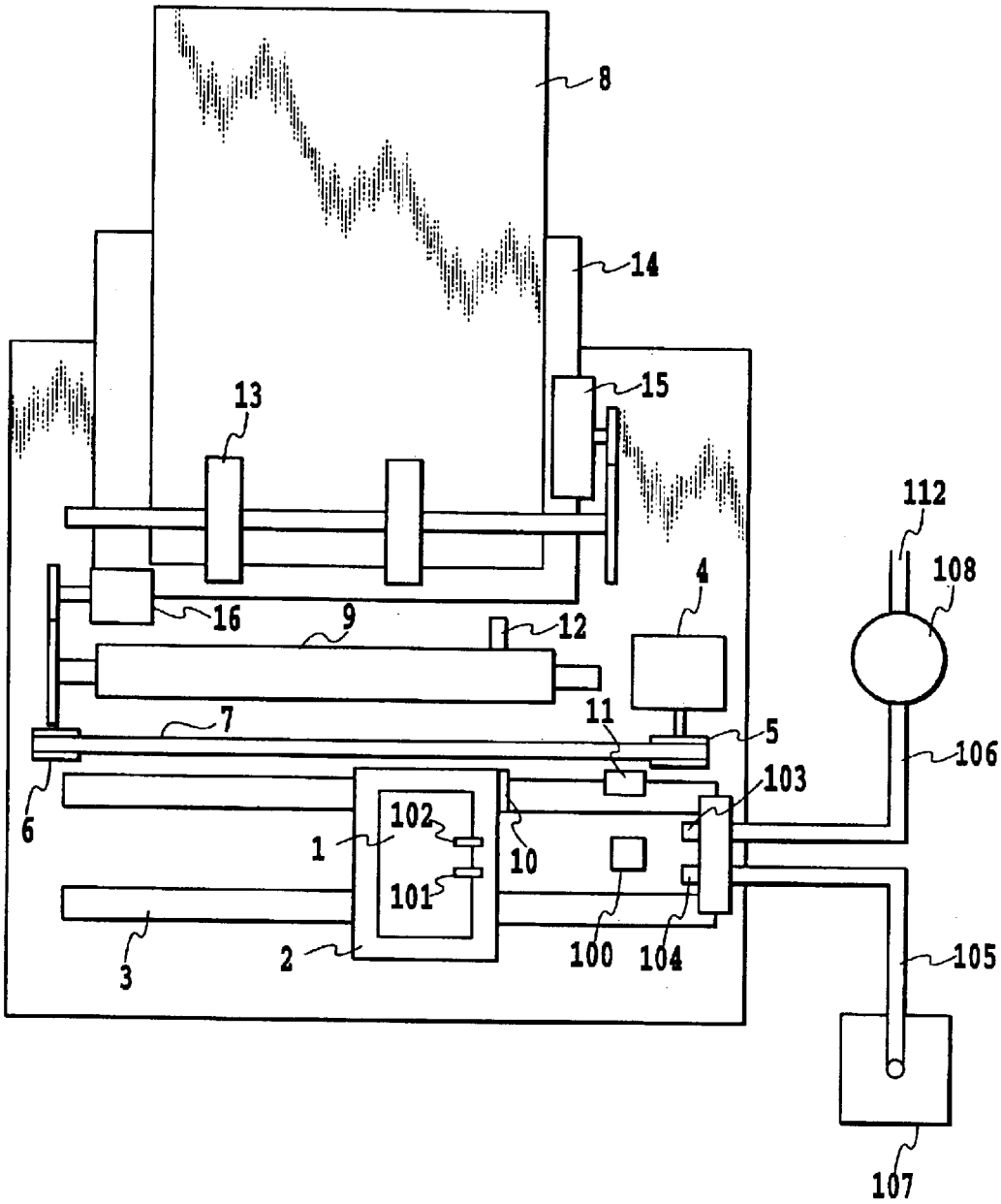
FIG. 1 is a schematic plan view showing a general structure of an inkjet printing apparatus utilizing an intermittent supply system according to an embodiment of the invention.

FIG. 1 is a schematic plan view showing a general structure of an inkjet printing apparatus utilizing an intermittent supply system according to an embodiment of the invention.

In the structure in FIG. 1, a printing head unit 1 is replaceably mounted on a carriage 1. The printing head unit 1 has a printing head section and a second ink tank section, and there is provided a connector (not shown) for transmitting signals such as a drive signal for driving the head section to cause an ink ejecting operation of a nozzle. The carriage 2 on which the printing head unit 1 is positioned and replaceably mounted is provided with a connector holder (electrical connecting section) for transmitting signals such as the drive signal to the printing head unit 1 through the connector.

The carriage 2 is guided and supported by a guide shaft 3 provided on a main body of the apparatus and extending in a main scanning direction such that it can be moved back and forth along the guide shaft. The carriage 2 is driven and controlled with respect to its position and movement by a main scanning motor 4 through transmission mechanisms such as a motor pulley 5, a driven pulley 6, and a timing belt 7. For example, a home position sensor 10 in the form of a transmission type photo-interrupter is provided, and a blocking plate 11 is disposed in a fixed part of the apparatus associated with a home position of the carriage such that it can block an optical axis of the transmission type photo-interrupter. Thus, when the home position sensor 10 passes through the blocking plate 11 as a result of the movement of the carriage 2, the home position is detected, and the position and movement of the carriage can be controlled using the detected position as a reference.

Printing media 8 that are printing paper or plastic sheets are separately fed one by one from an automatic sheet feeder (hereinafter referred to as an ASF) by rotating a pick-up roller 13 with an ASF motor 15 through a gear.

Further, the medium is transported through a position (printing section) in a face-to-face relationship with a surface of the printing head unit 1 where ejection openings are formed as a result of the rotation of a transport roller 9 (sub scanning). The transport roller 9 is driven by transmitting the rotation of a line feed (LF) motor 16 through a gear.

At this time, judgment on whether the paper has been fed and decision of a print starting position on the printing medium in a sub scanning direction is performed based on output of a paper end sensor 12 for detecting the presence of a printing medium disposed upstream of a printing position on a printing medium transport path.

The paper end sensor 12 is used to detect a rear end of a printing medium 8 and to decide a final printing position on the printing medium in the sub scanning direction based on the detection output.

The printing medium 8 is supported by a platen (not shown) at a bottom surface thereof such that a flat surface is formed in a portion thereof to be printed. In doing so, the printing head unit 1 carried by the carriage 2 is held such that the surface thereof where the ejection openings are formed protrudes downward from the carriage in parallel with the printing medium 8. For example, the printing head unit 1 is an inkjet printing head unit having a structure for ejecting ink utilizing thermal energy and having an electrothermal transducer for generating thermal energy that causes film boiling of ink. That is, the printing head of the printing head unit 1 performs printing by utilizing the pressure of bubbles generated as a result of film boiling of ink caused by the thermal energy applied by the electrothermal transducer to eject ink. Obviously, a different type of unit such as a unit that ejects ink utilizing a piezoelectric device may be used.

Reference numeral 100 represents a recovery system mechanism that has a cap member used for an operation of recovering suction of ink from the printing head unit 1 and for protecting the surface of the printing head where the ejection openings are formed. The cap member can be set in positions where it is joined to and detached from the surface where the ejection openings are formed by a motor that is not shown. Operations such as the suction recovery operation of the printing head are performed by generating a negative pressure in the cap member by a suction pump which is not shown in the joined state. The surface of the printing head where the ejection openings are formed can be protected by keeping the cap member in the joined state when the printing apparatus is not used.

Reference numeral 101 represents a valve unit provided on the printing head unit side for coupling the printing head unit 1 to an ink supply source. Reference numeral 104 represents a valve unit provided at the ink supply source side to be paired with the valve unit 101. Reference numeral 102 represents a valve unit provided on the printing head unit side for coupling the printing head unit 1 to an air pump unit. Reference numeral 103 represents a valve unit provided on an air pump unit side to be paired with the valve unit 102.

The valve units 101 through 104 are in contact and coupled with the respective valve units to allow ink and air to flow between the valve units when the carriage 2 is located at the home position outside a printing area in the main scanning direction or at a position in the vicinity of the same. The valve units are decoupled from each other when the carriage 2 moves away the position toward the printing area, and the valve units 101 and 104 automatically enter a closed state as a result of the decoupling. On the contrary, the valve unit 102 is always in an open state.

Reference numeral 105 represents a tube member that is coupled with a first ink tank 107 to supply ink to the valve unit 104. Reference numeral 106 represents a tube member for an air pressure or pneumatic circuit, the tube member being coupled with a pump unit 108 for pressurization and depressurization. Reference numeral 112 represents a suction and exhaust port of the pump unit 108. It is not essential to configure each of the tube members as an integral unit, and it may be configured by combining a plurality of tube elements.

(Another Example of Structure of Inkjet Printing Apparatus)

The intermittent supply system in FIG. 1 has a structure in which the valve units are coupled only when the second ink tank is charged with ink and in which the ink supply system between the first and second ink tanks is spatially disconnected during a printing operation. An intermittent supply system may be employed in which the ink channel or a fluid path is blocked with a valve instead of such disconnection to achieve fluid isolation between the first and second ink tanks.

Figure 2:
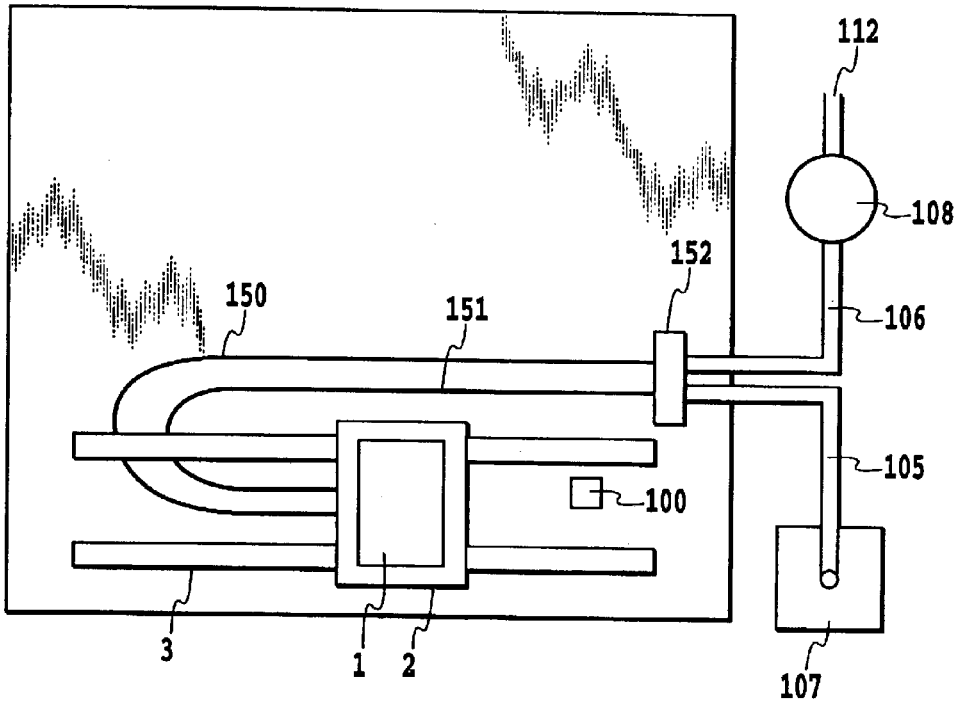
FIG. 2 is a schematic plan view showing a general structure of an inkjet printing apparatus employing an intermittent supply system utilizing a normally connected tube mechanism unlike the structure in FIG. 1.

FIG. 2 schematically shows an inkjet printing apparatus in which an intermittent supply system utilizing a normally connected tube mechanism is used. For simplicity, FIG. 2 does not show parts which can be configured similarly to those in FIG. 1 and which are not related to the description of the supply system of the present example.

In FIG. 2, reference numeral 150 represents a flexible tube for an air pressure circuit that is connected to a second ink tank of a printing head unit at one end thereof and connected to a pump unit 108 for pressurization and depressurization through an electromagnetic valve unit 152 and a tube member 106 for the air pressure circuit at another end thereof. Reference numeral 151 represents a flexible tube for supplying ink that is connected to the second ink tank of the printing head unit at one end thereof and connected to first ink tank 107 through the electromagnetic valve unit 152 and a tube member 105 for supplying ink at another end thereof.

That is, an intermittent supply system may be configured even using such a normally connected tube mechanism by interposing units for opening to form and closing to block a channel such as the electromagnetic valve unit 152 and by controlling the opening and closing of the same appropriately during an operation of charging the second ink tank with ink and a printing operation.

(Example of Structure of Control System)

Figure 3:
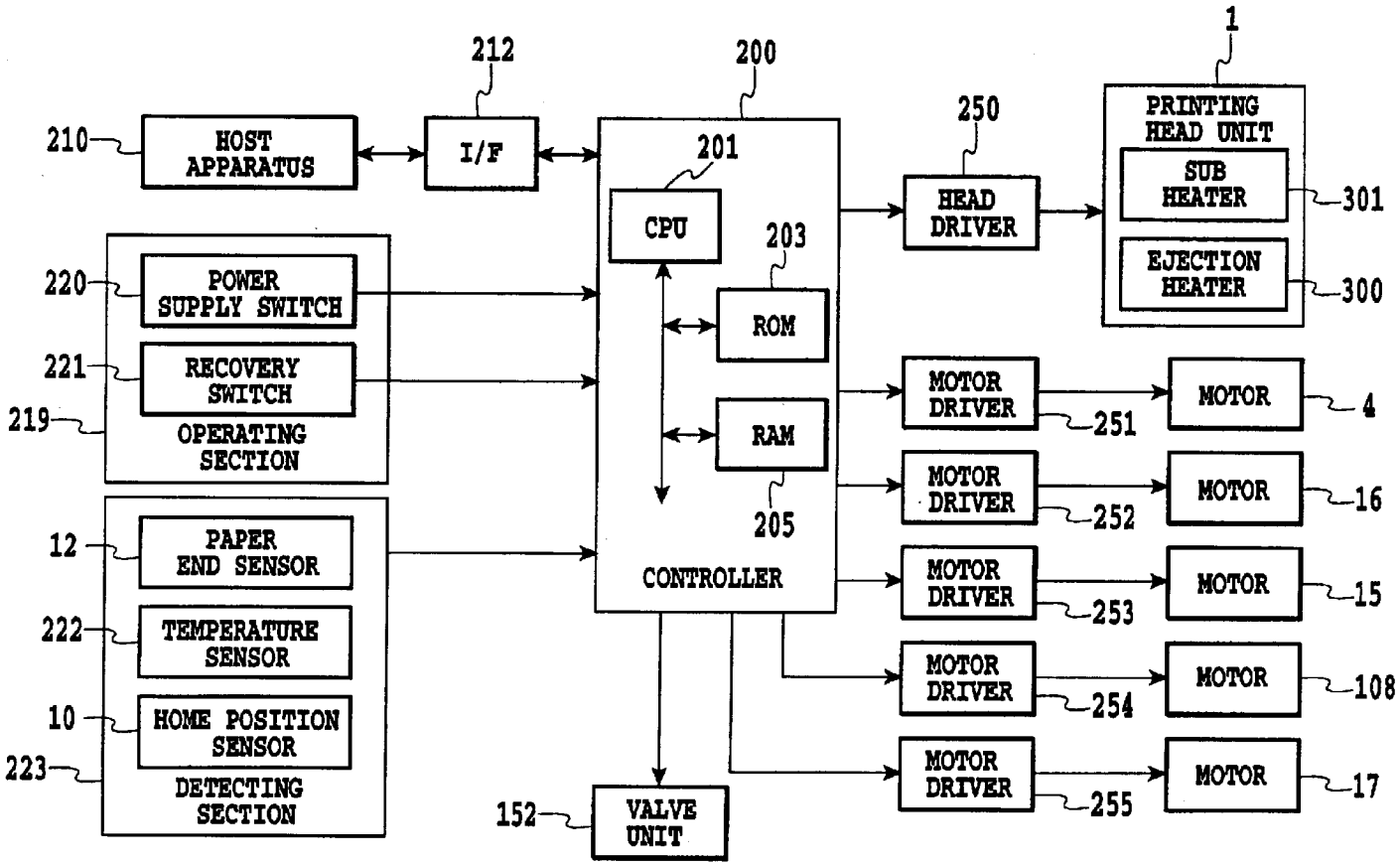
FIG. 3 is a block diagram showing an example of a schematic structure of a control system in the inkjet printing apparatus in FIG. 1 or FIG. 2.

FIG. 3 is a block diagram showing an example of a schematic structure of a control system in the inkjet printing apparatus in FIG. 1 or FIG. 2.

In FIG. 3, a controller 200 serves as a main control section and has a CPU 201 in the form of a microcomputer, a ROM 203 in which fixed data such as programs and required tables are stored, and a RAM 205 having areas such as an area for arranging image data and a work area, for example. A host apparatus 210 is a supply source of image data which may be a computer for generating and processing data such as image to be printed and may alternatively be a reader for reading images or a digital camera. An inkjet printing apparatus according to the present embodiment or the invention may be configured separately from such a host apparatus 210 or may be configured integrally with the same in a separable or inseparable manner.

Image data, commands, and status signals are transmitted and received to and from the controller 200 through an interface 212. An operating section 219 has a power supply switch 220 and switches for accepting input of instructions of an operator such as recovery switch 221 for instructing activation of suction recovery. A detecting section 223 has sensors for detecting states of the apparatus such as the home position sensor 10 described above, a paper end sensor 12 for detecting the presence of a printing medium, and a temperature sensor 222 provided in an appropriate part for detecting the ambient temperature.

A head driver 250 is a driver for driving an electrothermal transducer (ejection heater) 300 of the printing head 1 according to printing data. The head driver 250 has a shift register for arranging printing data in association with the position of the ejection heater 300, a latch circuit for latching the arranged printing data at appropriate timing, a logic circuit element for actuating the ejection heater in synchronism with a drive timing signal, and a timing setting section for appropriately setting ejection heater drive timing (ejection timing) to perform registration of dot forming positions (a registration process) as needed. The printing head 1 is also provided with a sub-heater 301 for performing temperature adjustment in order to stabilize ink ejection characteristics. The sub-heater 301 may have a structure in which it is formed on a substrate of the printing head concurrently with the ejection heater 300 and/or a structure in which it is mounted to the printing head main body or printing head unit.

Reference numeral 251 represents a motor driver for driving the main scanning motor 4; reference numeral 252 represents a motor driver for driving the line feed (LF) motor 16; and reference numeral 253 represents a motor driver for driving the ASF motor 15. Reference numeral 254 represents a driver for driving and controlling the pump unit 108, and reference numeral 255 represents a motor driver for driving a motor 17 for operating the recovery system.

Reference numeral 38 represents a driver for driving a valve unit for opening and closing the channel. While it is not required when the valve units 101 and 104 are used which are coupled with and separated from each other to cause the channel to open and close automatically as in the example of structure in FIG. 1, it is used in a structure in which the channel is passively opened and closed, i.e., when the electromagnetic valve 152 for opening and closing the ink channel is disposed as in the example of structure in FIG. 2.

(Example of Structure of Intermittent Supply System)

A structure and a basic operation of an intermittent supply system of an inkjet printing apparatus according to the invention in its simplest form are described.

Figure 4:
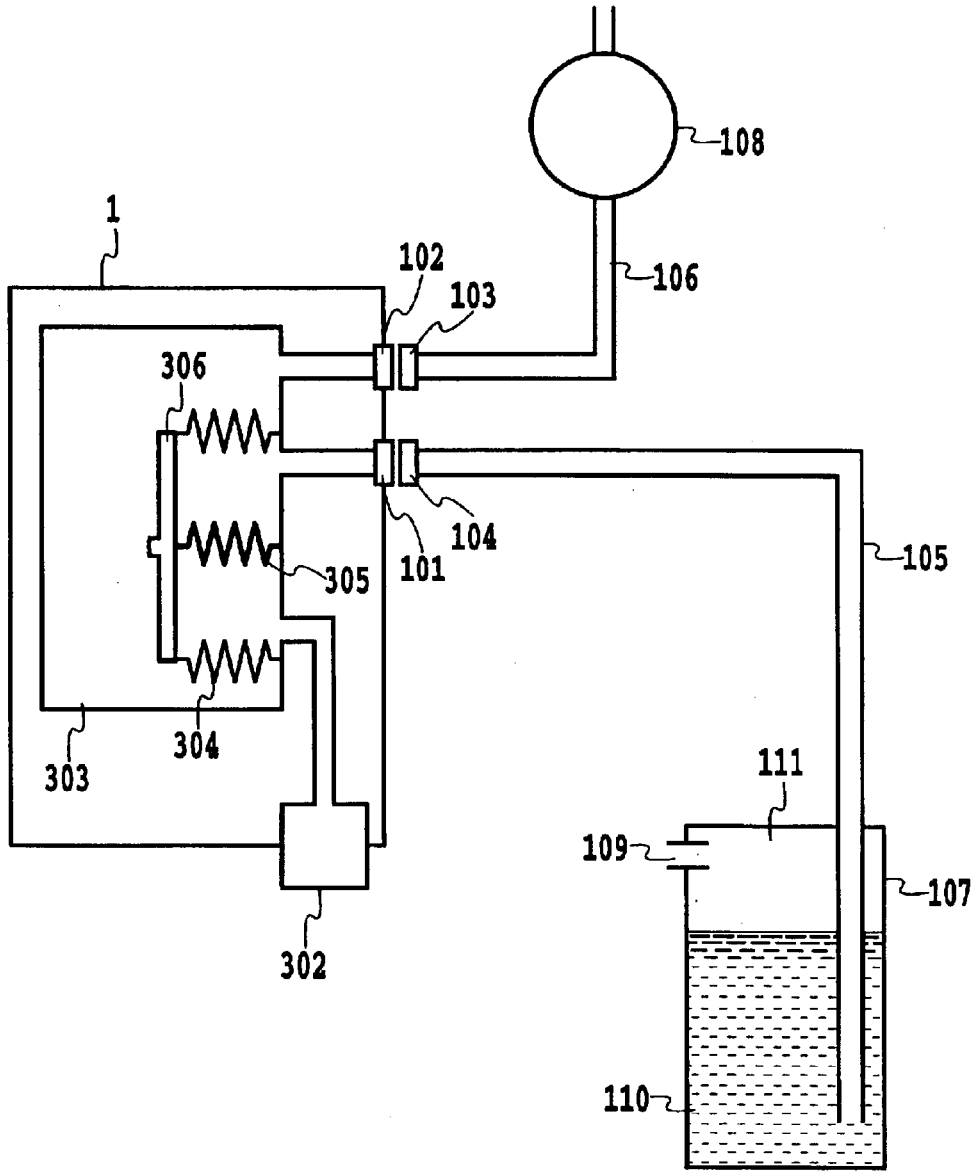
FIG. 4 is a schematic side view for explaining a first example of an internal structure of a printing head unit used for the intermittent supply system in the structure in FIG. 1 and connection circuits coupled with and located around the same.

FIG. 4 is an illustration for explaining an internal structure of a printing head unit 1 used for the intermittent supply system in the structure in FIG. 1 and connection circuits coupled with and located around the same. FIG. 4 shows the printing apparatus in its attitude during use, and the upside of the figure corresponds to upside in the vertical direction.

In FIG. 4, reference numeral 302 represents a printing head on which ejection openings or nozzles are arranged in a direction different from the main scanning direction (e.g., a direction orthogonal to the same). Ejection heaters are provided in liquid paths inside the ejection openings, and each of the liquid paths are in communication with a common liquid chamber to which ink may be introduced to distribute ink in each of the liquid paths.

Reference numeral 303 represents a shell element that is a structure for blocking communication between the internal structural body and the atmosphere in regions other than the valve units 102 and 101. Reference numeral 304 represents a second ink tank. The second ink tank 304 is constituted by a structural body having a flexible structure that can be displaced or deformed to have a variable internal volume in accordance with the pressure in the shell element 303, e.g., a structural body in the form of bellows. The tank is connected to the valve unit 101 with its interior in communication with the common liquid chamber in the printing head 302. As illustrated, in an attitude or orientation in use, the part connected to the valve unit 101 and the part in communication with the printing head 302 are in the highest and lowest positions respectively in the direction of gravity. Reference numeral 306 represents an abutting member provided at a displaced section of the structural body of the second ink tank 304.

Reference numeral 305 represents a compression spring that is coupled with each of a closed end portion 306 of the second ink tank 304 and the shell element 303 at an end thereof and that is set such that it exerts a force in the expanding direction or the direction of increasing the internal volume of the second ink tank 304. While the spring 305 is disposed in the second ink tank 304 in the illustrated example, it may be provided outside the same. In this case, either compression spring or tension spring may be used as long as it can exert a force in the direction of increasing the internal volume of the second ink tank 304. Instead of providing such a special spring, the material and structure of the second ink tank 304 may be appropriately selected, i.e., the bellows may be constituted by a rubber member for example to provide the second ink tank 304 with a structure which generates a negative pressure therein by itself and which can be displaced or deformed in the direction of increasing the internal volume.

In the case of an inkjet printing apparatus employing plural types of ink, a configuration may be used in which a plurality of second ink tanks 304 are provided in a common shell element 303.

The interior of the second ink tank 304 is put in communication with the first ink tank 107 through the tube member 105 when the valve units 101 and 104 are connected. A space inside the shell element 303 and outside the second ink tank 304 is coupled with the pump unit 108 through the tube member 106 when the valve units 102 and 103 are connected. The valve units 101 and 104 have a structure in which they form an ink channel when coupled with each other and close the same in an uncoupled state.

Figure 5A:
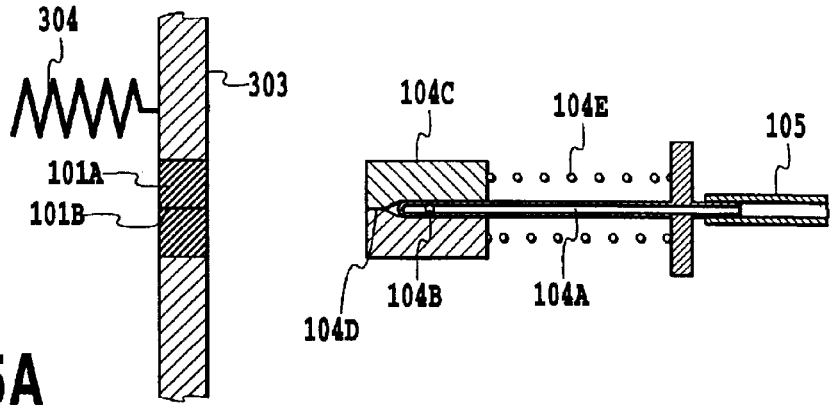
FIGS. 5A, 5B, and 5C are illustrations for explaining an example of a structure and operation of valve units for supplying ink that can be used in the structure in FIG. 4.
Figure 5B:
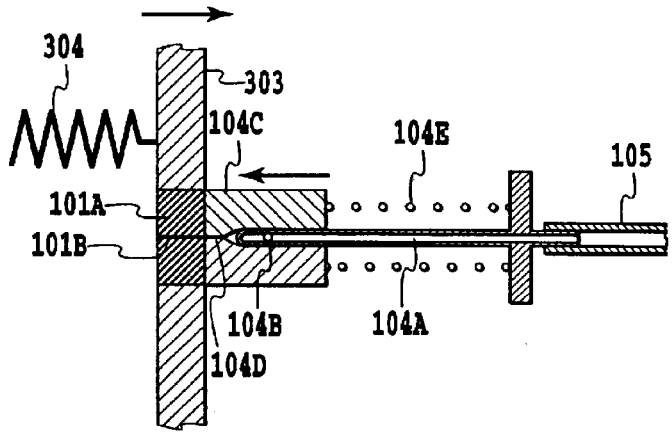
Figure 5C:
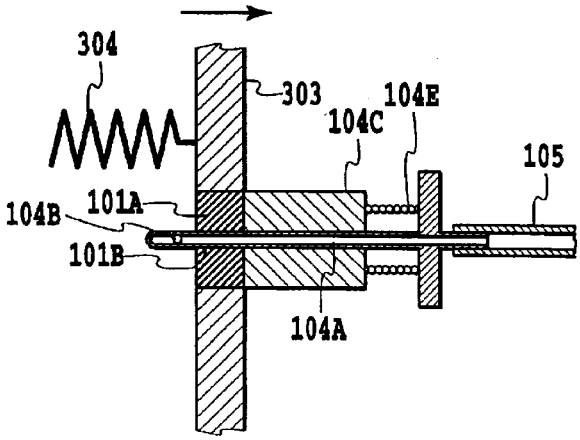

FIGS. 5A, 5B, and 5C are illustrations for explaining the structure and operation of the valve units 101 and 104.

In FIG. 5A, reference numeral 101A represents a sealing member that forms a part of the valve unit 101 and that is constituted by an elastic member such as rubber for sealing the interior of the ink tank 304, and a slit 101B is provided which is continuously extends between the inside and outside of the second ink tank 304. When the illustrated state in which the valve units 101 and 104 are not coupled, the slit 101B is closed by the elasticity of the sealing member 101A itself to keep the interior of the ink tank 304 in a gas-tight and liquid-tight state.

Reference numerals 104A through 104E represent members of which the valve unit 104 is made up. Reference numeral 104A represents a hollow needle member which is provided at an end of the tube member 105 and which has an opening 104B on a side in the vicinity of a tip end. Reference numeral 104C represents a closing member which covers the tip portion of the hollow needle member 104A including the opening 104B and which is constituted by an elastic member such as rubber. The closing member 104C has a slit 104D which continues to extend outwardly from the tip portion of the hollow needle member 104A. The closing member 104C is urged by a spring 104E provided at a flange portion of the hollow needle 104A. It is held in the illustrated position when the valve units 101 and 104 are in the uncoupled state, and the opening 104B of the hollow needle member 104A is closed by an inner wall of the through hole 104D.

When the shell 303 moves rightward in the figure for an ink charging operation from such a state in FIG. 5A, the sealing member 101A and the closing member 104C contact each other as shown in FIG. 5B.

When the shell element 303 further moves rightward in the figure, as shown in FIG. 5C, the spring 104E is compressed, and the tip of the hollow needle member 104A enters the second ink tank 304 while expanding the slits 104D and 101B by force, by which the opening 104B is located inside the second ink tank 304. This establishes communication between the first ink tank 107 and the second ink tank 304 through the tube member 105.

When the shell element 303 moves leftward in the figure after the ink charging operation is completed, the state shown in FIG. 5A is restored in which ink will not leak regardless of the attitude of the printing apparatus because the interiors of the second ink tank 304 and the first ink tank 107 are in a liquid tight state.

Obviously, the example in FIGS. 5A, 5B, and 5C is not limiting the invention, and various structures may be employed for the valve units 101 and 104 which thus form a channel in a coupled state and closes the same in an uncoupled state.

Unlike such valve units 101 and 104, the valve units 102 and 103 have no valve member to close the channel when they are disconnected. In particular, the space inside the shell member 303 and outside the second ink tank 304 is exposed to the atmosphere when they are disconnected.

(Example of Configuration of Pump Unit)

Referring to FIG. 4 again, the pump unit 108 may have a pump main body in the form of a diaphragm pump for example and a directional control valve that is connected to a working chamber of the pump main body and that can switch a fluid channel to the position of the atmosphere and to the position of the valve unit 103. When the valve units 102 and 103 are coupled with each other, the fluid channel is first set in the position of the atmosphere to perform a suction operation and is then set in the position of the valve units or shell element to perform an ejecting operation, which allows the interior of the shell element 303 to be pressurized. Conversely, the interior of the shell element 303 can be depressurized by setting the fluid channel toward the valve units or shell element to perform a sucking operation and by then setting the fluid channel toward the atmosphere to perform an ejecting operation.

Further, while depressurization is carried out by sucking air from the shell element 303 using the pump unit 108 in the present embodiment, a predetermined gas or liquid may alternatively be enclosed in the shell element 303 and a depressurizing force may be applied to the same.

In order to pressurize or depressurize the interior of the shell element 303 properly, the quantity of pressurization or depressurization must be adjusted in accordance with the space in the shell element 303, and the pump unit 108 may take various forms that serve such a purpose.

Figure 6:
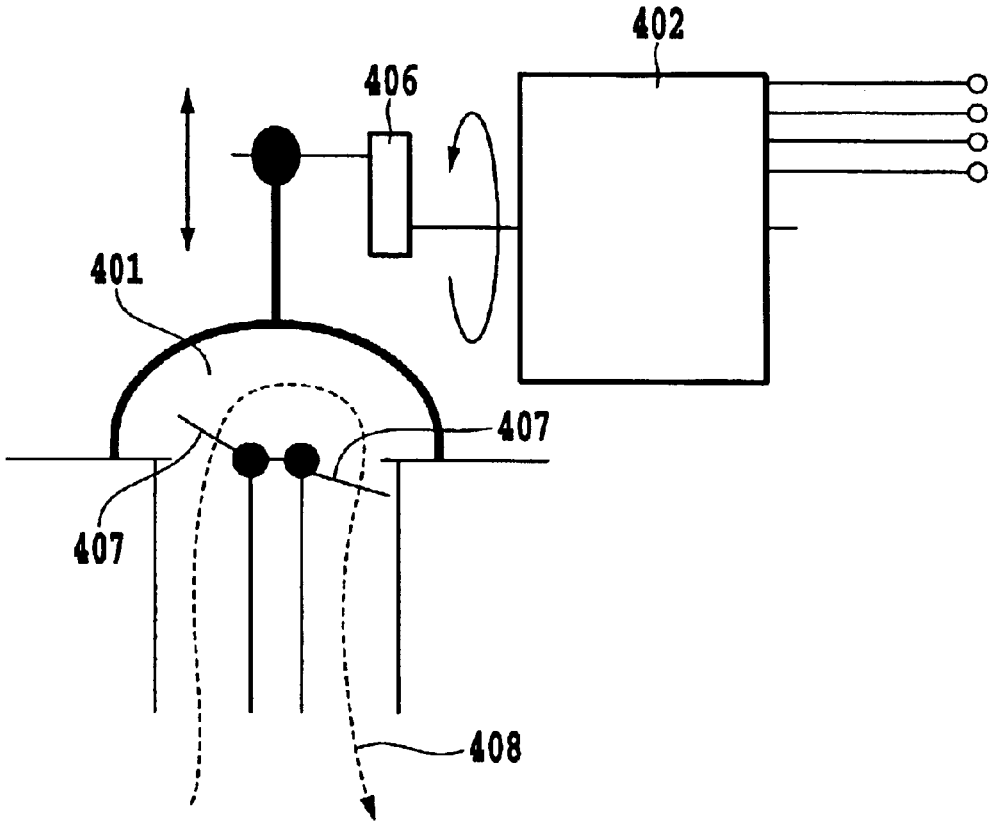
FIG. 6 is a schematic sectional view showing an example of a pump unit that can be used in the embodiment of the invention.

FIG. 6 shows an example of the same, and the illustrated pump unit has a configuration in which a diaphragm type pump 401 is driven by a stepping motor 402. The figure does not show the mechanism of the directional control valve that can switch the fluid channel toward the atmosphere and toward the valve unit 103.

A common type of pump may be used as the diaphragm type pump 401. It performs compression/expansion operation by moving the diaphragm in the directions indicated by the arrows in the figure by force with a crank member 406 provided on the shaft of the stepping motor 402, which makes it possible to generate a flow 408 through unidirectional valves 407. The cycle of compression and expansion of the diaphragm type pump 401 is precisely determined to control the total quantity of the flow and the flow rate of the same precisely by inputting a number of steps of rotation and a speed to the stepping motor 402 through a driver 254 under the control of the controller 200 in FIG. 3.

Figure 7:
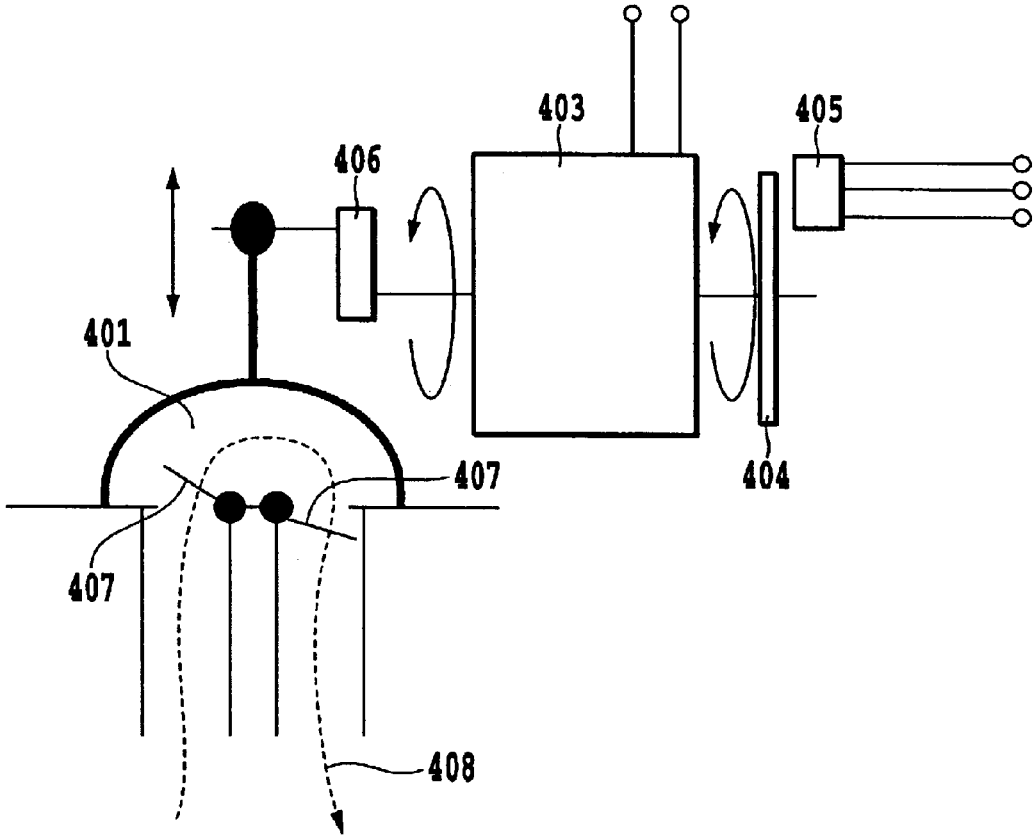
FIG. 7 is a schematic sectional view showing another example of the pump unit that can be used in the embodiment of the invention.

FIG. 7 shows another example of a configuration of the pump unit 108 in which the diaphragm type pump 401 is driven by a DC motor 403. The figure also omits the mechanism of the directional control valve that can switch the fluid channel toward the atmosphere and toward the valve unit 103.

In this configuration, a mechanism similar to that shown in FIG. 6 is employed as a mechanism for moving the diaphragm. An encoder 404 is provided on the shaft of the DC motor 403, and the rotation of the encoder 404 is detected with an encoder sensor 405 and fed back to a driver 254 to allow closed-loop control of the number of rotation and speed of the DC motor 403. This makes it possible to precisely control the total quantity and speed of a flow from the diaphragm type pump 401 similarly to the configuration in FIG. 6.

The pump unit 108 is not limited to the configurations shown in FIGS. 6 and 7 and may obviously configured in various ways. That is, various pumps may be employed other than diaphragm types, and the driver of the same is not limited to electrical types.

Figure 8:
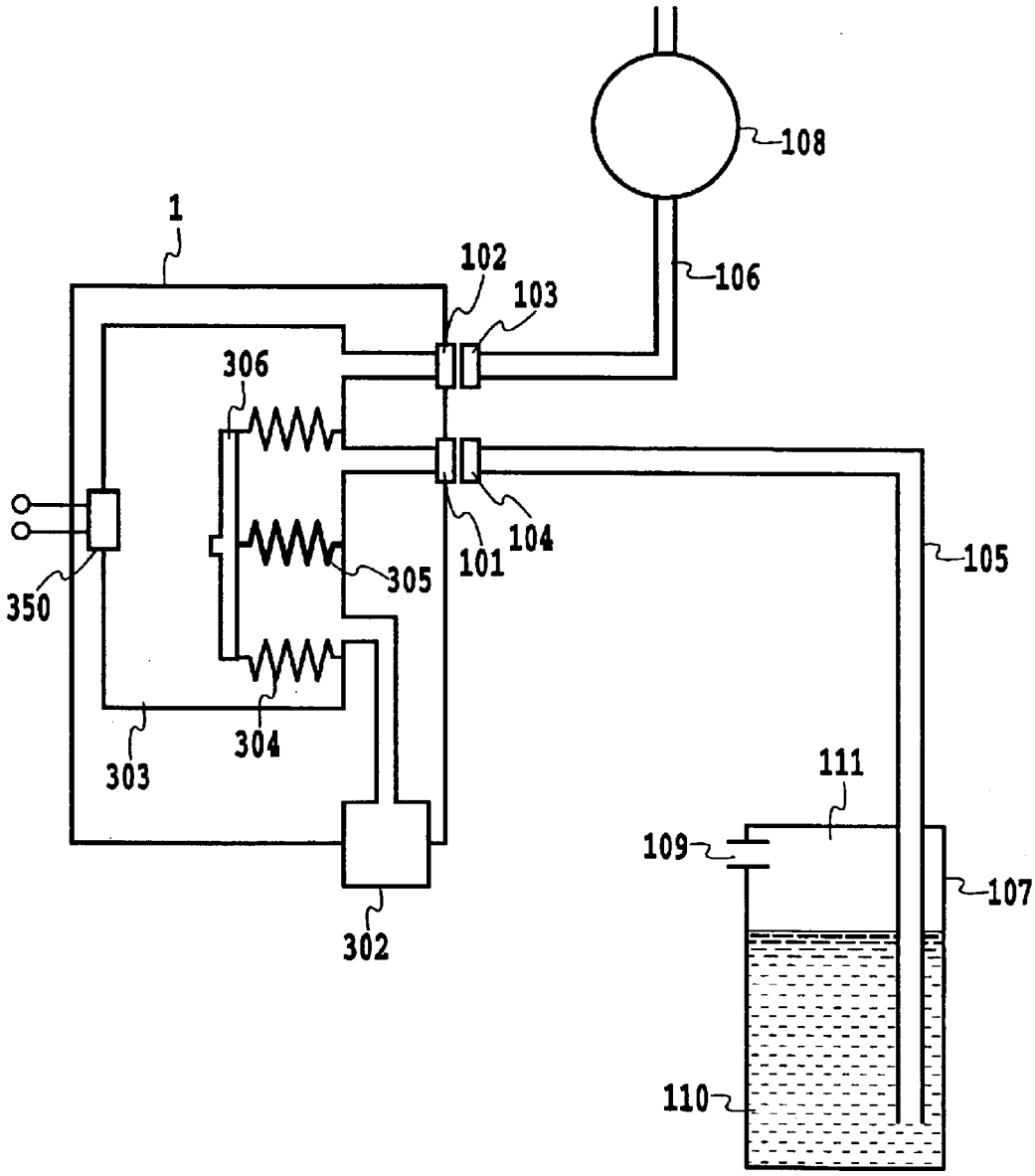
FIG. 8 is a schematic side view showing another example of the printing head unit that can be used for the intermittent supply system in the structure in FIG. 1 and that performs a control of pressurization or depressurization of the interior thereof more accurately.

In any configuration, the control of the pump unit 108 or the control of pressurization or depressurization of the interior of the shell element 303 can be more accurately performed by providing a pressure sensor 350 for detecting the pressure in the shell element 303 as shown in FIG. 8 and providing feedback of information on the detection of the internal pressure.

While various configurations are possible for the first ink tank 107 for reserving ink 110 to be supplied to the second ink tank 304 or the printing head 302, the present embodiment employs a configuration including an atmosphere communication section 109 such that communication with the atmosphere is always kept to maintain the internal pressure at the atmospheriec pressure.

While the atmosphere communication section 109 may be a simple hole as long as it is located in a position higher than the ink level, a functional film which allows gases to pass and disallows liquids to pass may be provided from the viewpoint of more effective prevention of leakage of ink. The tip of a tube member 105 that is stuck into the first ink tank to transport ink is located at its lowest position in the ink tank in the direction of gravity in the illustrated attitude or orientation in use. This is advantageous in using up ink without any residue.

In the structure of the present embodiment, the first ink tank 107 and the second ink tank 304 have no sponge such that ink is contained in the spaces therein as it is.

The configuration therefore allows ink and a gas to be quickly separated from each other downward and upward respectively in the direction of gravity without any obstacle.

(Example of Ink Charging Process)

Figure 9:
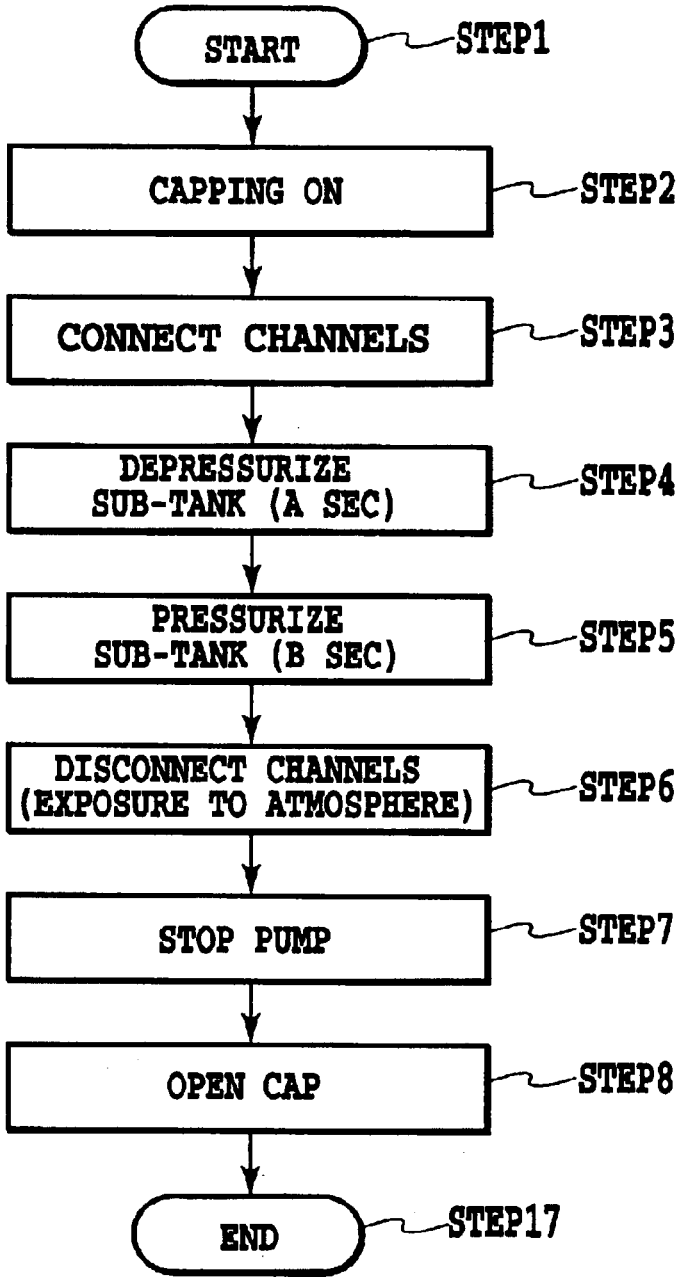
FIG. 9 is a flow chart showing an example of a processing procedure for charging ink from a first ink tank to a second ink tank in the structure in FIG. 1.

FIG. 9 shows an example of a processing procedure for charging ink from the first ink tank 107 to the second ink tank 304 in the above structure.

For example, when image data are supplied and printing is instructed by the host apparatus 210 to activate the procedure (Step 1), a capping operation is first performed at Step 2. This is an operation of moving the cap section of the recovery system mechanism indicated by reference numeral 100 in FIG. 1 to put it in tight contact with the surface of the printing head 302 in FIG. 4 where the ejection openings are formed, thereby forming a closed system in that part.

An operation of connecting the valve units 101 through 104 is then performed at Step 3. That is, the carriage 2 is moved in the main scanning direction in the structure in FIG. 1 to cause the valve units 101 and 102 to abut on the valve units 104 and 103 respectively, thereby forming an ink channel and an air channel. The invention is not limited to this method of connection. The channels in the valve units 101 and 104 are closed until they are connected, and both of the channels are opened and coupled with each other at the time of connection. The valve units 102 and 103 are always open, and an air channel is formed as they are coupled.

The procedure then proceeds to Step 4 where a depressurizing operation is performed by the pump unit 108. Since this depressurizes the interior of the shell element 303 (the interior of the sub tank chamber) relative to the atmosphere, the second ink tank 304 expands, and ink flows into the second ink tank 304 through the tube member 105 and the valve units 104 and 101. When the depressurizing operation is continued for a predetermined time (A seconds), the expansion of the second ink tank 304 eventually comes to a limit according to the depressurizing force and the applying period thereof, and any further expansion is prevented and the internal volume of the second ink tank 304 is maximized.

It is strongly desired to keep a change attributable to the depressurization of the second ink tank 304 smaller than a meniscus holding ability of the printing head by changing the pressure in the pump unit 108 gently. Units for controlling the change attributable to depressurization of the second ink tank 304 include: a unit that performs so-called open-loop control in which the pump unit 108 is operated by providing it with a signal determined in advance by characteristics of constituent elements of the inkjet printing apparatus such as the pump unit 108, the second ink tank 304, the tube member 105, the valve units 104 and 101, and ink and results of monitoring performed by a status monitor (such as a counter) including the amount of ink consumed; and a unit that performs so-called closed loop control in which the operation of the pump unit 108 is controlled by providing feedback of a signal from the pressure sensor 350. Either of the units may be selected depending on situations.

When Step 4 is completed, the spring 305 may be in a neutral state or expanded state in which a proper negative pressure cannot be exerted to the printing head 302.

Then, the procedure proceeds to Step 5 after the depressurizing operation at Step 4 to perform a pressurizing operation for a short time (B seconds), i.e., an operation of forcing a small amount of the ink in the second ink tank 304 back to the first ink tank 107 to cause the second ink tank 304 to contract, thereby generating a proper negative pressure with the compression spring 305. It is strongly desired again to keep a change attributable to the pressurization of the second ink tank 304 smaller than the meniscus holding ability of the printing head by changing the pressure in the pump unit 108 gently. A unit for control of a change attributable to pressurization of the second ink tank 304 may be selected just as in the case of control of a change attributable to depressurization.

Next, the carriage 2 is moved toward the printing area in the main scanning direction at Step 6 to decouple the valve units. At this time, both of the valve units 101 and 104 operate to close the channel, and the valve unit 102 is left in the open state. The pressurizing operation therefore substantially terminates then. Subsequently, the driving of the pump unit 108 is stopped at Step 7, and the capped state provided by the recovery system mechanism 100 is canceled at Step 8 to terminate the process (Step 17).

In the present example, when the valve units are disconnected after the operation of charging ink to the second ink tank 304 is completed to expose the interior of the shell element 303 to the atmosphere (Step 6) and to stop the pressurizing operation substantially, the second ink tank 304 is urged by the compression spring 305 in the direction of expanding the same, thereby generating an adequate negative pressure in the second ink tank 304. That is, the compression spring 305 can be displaced in the direction of increasing the internal volume of the second ink tank 304 after the series of charging operations are completed. The expansion of the second ink tank 304 stops when it is balanced against the meniscus holding ability of the printing head. This enables printing.

The spring constant of the compression spring 305 is desirably set such that the negative pressure is maintained in a range of optimum values at which ink can be ejected from the printing head properly from this state until the internal volume of the second ink tank 304 is minimized as a result of the consumption of ink.

In the event that air enters the second ink tank 304, the air is tempted to expand in response to a temperature rise. When the ink charging operation has then proceeded to disallow any further expansion of the second ink tank 304, a problem can arise in that the internal pressure of the second ink tank increases to cause ink to leak through the ejection openings. It is therefore desirable to limit the ink charging operation to such a range that the second ink tank itself can still expand in order to allow the expansion of air. It is therefore desirable to limit the depressurization and expansion of the second ink tank 304 within an appropriate range or to actively perform an additional pressurizing operation as described above for this reason too.

While the present embodiment has been described with reference to examples involving a single second ink tank 304, ink can be supplied in the same procedure as for a single ink tank even when a plurality of second ink tanks 304 are provided in a common shell element 303 to use plural types of ink by taking measures to control changes attributable to depressurization and pressurization of the second ink tanks 304.

The above structure and process make it possible to supply ink to the second ink tank intermittently in a simple manner without generating any waste ink as a result of a charging operation.

A structure is employed with which the internal volume of the second ink tank 304 can be varied to generate an adequate negative pressure, and the second ink tank 304 itself functions as an actuator for charging ink by varying the internal volume thereof, by which those operations can be achieved by driving and controlling a single source of driving.

Although a capping operation is performed at the beginning of the ink charging process in the above procedure, the capping operation may be omitted when fluctuations of the pressure in the second ink tank 304 determined by the rate of expansion of the second ink tank 304 and the relationship between ink channel resistances of the first ink tank 107 and the second ink tank 304 are smaller than the meniscus holding pressure of the ejection openings. Such an alternative may be taken when the rate of expansion is low because of a low ink flow rate and when the resistances of the channels are small because of great channel sectional areas, for example.

(Others)

In the above-described embodiments, a single second ink tank is contained in a shell element, i.e., an intermittent supply system is configured to accommodate one type of ink. While a second ink tank may be contained in each of a plurality of shell elements to configure intermittent supply systems for two or more colors or two or more types of ink, it is preferred to contain a plurality of second ink tanks in a single shell element. The reason is that a printing apparatus can be made compact by using a common mechanism for pressurization and depressurization (a pump unit 108) and a common shell element; a common peripheral mechanism can be used even when second ink tanks of different sizes must be used for respective colors or ink types; and all second ink tanks can be quickly charged with optimum amounts of ink using a single control sequence for a single pump unit without a need for controlling them separately even when the second ink tanks have different amounts of remaining ink.

The embodiment described above corresponds to the printing apparatus in FIG. 1 having a structure in which the valve units are coupled only when the second ink tank is charged with ink and in which the ink supply system between the first and second ink tanks is spatially disconnected during a printing operation. However, those basic structures may be applied to the printing apparatus in FIG. 2 that employs an intermittent supply system configured to achieve fluid isolation between the first and second ink tanks without performing such disconnection.

That is, one end of a flexible tube member 150 for an air pressure circuit and one end of a flexible tube member 151 for supplying ink may be connected to the printing head 1 or the shell member 303 shown in FIG. 4, and channel opening and closing units such as electromagnetic valve units 152 may be interposed between the tube members 150, 151 and the tube members 106, 105 instead of the valve units 101 through 104. An operation similar to that of the above embodiments can be performed by actuating the electromagnetic valve units 152 during a charging operation to connect the second ink tank 304 and the first ink tank 107 and to connect the interior of the shell element 303 and the pump unit 108.

As described above, the invention makes it possible to provide a structure which does not fundamentally result in waste of ink such as generation of waste ink associated with a charging operation to apply a predetermined negative pressure to a printing head, which achieves high charging efficiency and a short charging time, and which can be easily kept resistant to ink, i.e., a structure with which freedom in selecting ink can be increased. The invention thus contributes to the structure of a compact and portable inkjet printing apparatus.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink container that can be disposed halfway of an ink supply path connecting a printing head for performing printing by ejecting ink and an ink tank serving as a supply source of ink to be supplied to said printing head, comprising:

an ink containing body capable of containing ink introduced thereto from said ink tank in a state in which it is in fluid communication with said ink tank, said ink containing body supplying the ink contained therein to said printing head during printing and having a part that can be displaced in the direction of increasing an internal volume thereof to introduce the ink;

a housing having an inner space in which a pressure can be adjusted, said housing allowing said ink containing body to be contained in the space and allowing an increase in the internal volume thereof in accordance with the pressure adjustment; and urging means provided at said ink containing body for urging said ink containing body in the direction of increasing of the internal volume of the same to generate a negative pressure that is in equilibrium with an ability to hold meniscus formed at an ink ejecting portion of said printing head, wherein said ink containing body has a flexible structure which expands when the inner space of said housing is depressurized to increase said internal volume and which contracts when the inner space of said housing is pressurized to decrease said internal volume; and said urging means generates said negative pressure when the inner space of said housing is pressurized to decrease the internal volume of said ink containing body after the internal volume of said ink containing body is maximized as a result of depressurization of the inner space of said housing.

2. An ink container as claimed in claim 1, wherein said ink containing body has a member having an end attached to an inner wall of said housing and another end that can be displaced according to the expansion; and said member can be put in fluid communication with said ink tank through a channel extending through said wall of said housing and the end.

3. An ink container as claimed in claim 2, wherein said urging means has a spring for urging the other end of said member in the direction of expanding of said member.

4. An ink container as claimed in claim 1, wherein the pressure in the inner space of said housing is adjusted using a gas or a liquid as a medium.

5. An ink container as claimed in claim 1, wherein said housing contains said ink containing body in a quantity corresponding to the types of inks to be used.

6. An ink container as claimed in claim 1, having a configuration in which said ink container is directly connected to said printing head.

7. An ink container as claimed in claim 1, further comprising means for detecting the pressure of the internal space of said housing.

8. An inkjet printing apparatus utilizing a printing head for performing printing by ejecting ink, an ink tank serving as a supply source of ink to be supplied to said printing head, and an ink container as claimed in claim 1 provided halfway of an ink supply path connecting them, comprising:

a channel opening and closing unit for establishing and blocking fluid communication between said ink tank and said ink containing body; and a pressure regulating unit for reducing the pressure in the inner space of said housing in the communicated state to increase the internal volume of said ink containing body and for increasing the pressure in the inner space of said housing to decrease the internal volume of said ink containing body.

9. An inkjet printing apparatus as claimed in claim 8, wherein said ink container has a pressure detecting means for detecting the pressure in the inner space; and said pressure regulating unit limits a change in the pressure in said ink container by performing pressure adjustment using detection information on the pressure detected by said pressure detecting means.

10. An ink supplying method used for an inkjet printing apparatus utilizing a printing head for performing printing by ejecting ink, an ink tank serving as a supply source of ink to be supplied to said printing head, and an ink container as claimed in claim 1 provided halfway of an ink supply path connecting them, and used for supplying the ink to said ink container from said ink tank, said method comprising the steps of:

establishing fluid communication between said ink tank and said ink containing body;

reducing the pressure in the inner space of said housing in the communicated state to increase the internal volume of said ink containing body, thereby introducing ink from said ink tank to said ink containing body; and increasing the pressure in the inner space of said housing in the communicated state to decrease the internal volume of said ink containing body, thereby introducing ink from said ink containing body to said ink tank, a negative pressure being thus generated in said ink containing body in equilibrium with an ability to hold meniscus formed at an ink ejecting portion of said printing head.

11. An ink supplying method as claimed in claim 10, wherein a change of the pressure in said ink containing body at the time of introduction of ink from said ink tank to said ink containing body and/or a change of the pressure in said ink containing body at the time of introduction of ink from said ink containing body to said ink tank is kept smaller than the ability to hold meniscus formed at the ink ejecting portion of said printing head.

12. An ink supplying method as claimed in claim 11, wherein said change in the pressure is limited by performing pressure adjustment using detection information on the pressure in the inner space of said ink container.

13. A printing head unit comprising:

a printing head for performing printing by ejecting ink; and an ink container that can be disposed halfway of an ink supply path connecting said printing head and an ink tank serving as a supply source of ink to be supplied to said printing head, having:

an ink containing body capable of containing ink introduced thereto from said ink tank in a state in which said ink containing body is in fluid communication with said ink tank, said ink containing body supplying the ink contained therein to said printing head during printing and having a part that can be displaced in the direction of increasing an internal volume thereof to introduce the ink;

a housing having an inner space in which a pressure can be adjusted, said housing allowing said ink containing body to be contained in the space and allowing an increase in the internal volume thereof in accordance with the pressure adjustment; and urging means provided at said ink containing body for urging said ink containing body in the direction of increasing of the internal volume of the same to generate a negative pressure that is in equilibrium with an ability to hold meniscus formed at an ink ejecting portion of said printing head, wherein said ink containing body has a flexible structure which expands when the inner space of said housing is depressurized to increase said internal volume and which contracts when the inner space of said housing is pressurized to decrease said internal volume; and said urging means generates said negative pressure when the inner space of said housing is pressurized to decrease the internal volume of said ink containing body after the internal volume of said ink containing body is maximized as a result of depressurization of the inner space of said housing.

14. A printing head unit as claimed in claim 13, wherein said printing head has a heating element for generating thermal energy that causes film boiling of ink as energy used to eject the ink.

15. A method for supplying ink to an ink container for containing ink to be supplied to a printing head for performing printing by ejecting ink from an ink tank, said ink container accommodating an ink containing body capable of containing the ink therein and capable of generating a negative pressure by an elastic force, said method comprising the steps of:

establishing fluid communication between said ink tank and said ink containing body;

depressurizing the interior of said ink container to expand said ink containing body, thereby introducing the ink to said ink containing body from said ink tank; and pressurizing the interior of said ink container to contract said ink containing body, thereby introducing ink from said ink containing body to said ink tank, a negative pressure being thus generated in said ink containing body in equilibrium with an ability to hold meniscus formed at an ink ejecting portion of said printing head.

16. A method for supplying ink to an ink container for containing ink to be supplied to a printing head for performing printing by ejecting ink from an ink tank, said ink container accommodating an ink containing body capable of containing the ink therein and capable of changing an internal volume thereof with a flexible structure, said method comprising the steps of:

establishing fluid communication between said ink tank and said ink containing body;

increasing the internal volume of said ink containing body, thereby introducing the ink to said ink containing body from said ink tank; and decreasing the internal volume of said ink containing body, thereby introducing ink from said ink containing body to said ink tank, a negative pressure being thus generated in said ink containing body in equilibrium with an ability to hold meniscus formed at an ink ejecting portion of said printing head.

* * * * *

UNITED STATES PATENT AND TRADEMARK OFFICE

CERTIFICATE OF CORRECTION

PATENT NO. : 6,783,215 B2
DATED : August 31, 2004
INVENTOR(S) : Masahito Yoshida et al.

It is certified that error appears in the above-identified patent and that said Letters Patent is hereby corrected as shown below:

Column 1,
Line 53, “type,” should read -- types, --.

Column 2,
Line 53, “contained a” should read -- contained in a --.

Column 3,
Line 41, “meniscus” should read -- a meniscus --.

Column 4,
Line 12, “hold meniscus” should read -- hold a meniscus --.

Column 5,
Lines 15 and 35, “hold meniscus” should read -- hold a meniscus --.

Column 9,
Line 8, “image” should read -- images --.

Column 10,
Line 67, “is” should be deleted.

Column 12,
Line 40, “rotation” should read -- rotations --;
Line 46, “obviously configured” should read -- obviously be configured --; and
Line 63, “atmospheriec” should read -- atmospheric --.

Column 16,
Line 33, “hold meniscus” should read -- hold a meniscus --.

Column 17,
Line 41, “meniscus” should read -- a meniscus --; and
Line 49, “hold a meniscus” should read -- hold a meniscus --.

UNITED STATES PATENT AND TRADEMARK OFFICE

CERTIFICATE OF CORRECTION

PATENT NO. : 6,783,215 B2
DATED : August 31, 2004
INVENTOR(S) : Masahito Yoshida et al.

It is certified that error appears in the above-identified patent and that said Letters Patent is hereby corrected as shown below:

Column 18,
Lines 11, 46 and 64, “hold meniscus” should read -- hold a meniscus --.

Signed and Sealed this

Twenty-second Day of February, 2005

JON W. DUDAS
*Director of the United States Patent and Trademark Office*